United States Patent [19]

Tkach et al.

[11] 4,121,672

[45] Oct. 24, 1978

[54] REVERSING PNEUMATIC PERCUSSIVE DEVICE

[76] Inventors: Khaim Berkovich Tkach, ulitsa Gogolya, 17, kv. 49; Alexander Dmitrievich Kostylev, ulitsa Derzhavina, 19, kv. 44; Konstantin Stepanovich Gurkov, ulitsa Derzhavina, 19, kv. 13; Boris Nikolaevich Smolyanitsky, ulitsa O.Dundicha, 27, kv. 18; Vladimir Dmitrievich Plavskikh, ulitsa Gogolya, 233/1, kv. 34; Vladimir Vasilievich Klimashko, ulitsa Novogodnaya, 44, kv. 24, all of Novosibirsk, U.S.S.R.

[21] Appl. No.: 809,312

[22] Filed: Jun. 23, 1977

[51] Int. Cl.[2] ..... E21B 11/02

[52] U.S. Cl. ..... 175/19; 173/91

[58] Field of Search ..... 175/19; 173/91

[56] References Cited

U.S. PATENT DOCUMENTS

| | | | |
|---|---|---|---|
| 3,137,483 | 6/1964 | Zinkiewicz | 175/19 |
| 3,616,865 | 11/1971 | Sudnighnikov et al. | 175/19 X |
| 3,651,874 | 3/1972 | Sudnighnikov et al. | 175/19 X |
| 3,705,633 | 12/1972 | Sudnighnikov et al. | 173/91 |
| 3,727,701 | 4/1973 | Sudnighnikov et al. | 173/91 |
| 3,756,328 | 8/1973 | Sudnighnikov et al. | 173/91 |

*Primary Examiner*—Stephen J. Novosad
*Assistant Examiner*—Richard E. Favreau
*Attorney, Agent, or Firm*—Lackenbach, Lilling & Siegel

[57] ABSTRACT

The device has a hollow cylindrical housing pointed at the front end and accommodating a hammer piston, which defines with the housing a front end work chamber and, which has at a rear end portion a cylindrical space and an open-ended radial passage. The cylindrical space receives the large portion of a stepped pipe in order to define with the hammer piston a rear end work chamber. The small portion of the pipe is received in the rear end portion of the housing for rotation about its axis within limits defined by a locking member and is connected, by means of a flexible hose, to a source of compressed air for permanent supply to the rear end work chamber of compressed air. The large portion of the stepped pipe opens the radial passage of the hammer piston at regular intervals to establish communication between the front end work chamber and the rear end work chamber, thereby enabling forward movement of the device. For reversing the movement of the device, the large portion of the pipe is provided at a front end face with a recess and at a rear end face with a projection located in alignment with the recess. The lengths of the recess and projection are such that when they are located in alignment with the radial passage, which is achieved by rotating the pipe within the limits defined by the locking member, air escapes from the front end work chamber at the position of the hammer piston in which blows are imparted to the rear end portion of the housing, and compressed air is admitted to the front end work chamber at the position of the hammer piston in which it is decelerated so as to prevent blows from being imparted to the front end portion of the housing.

1 Claim, 7 Drawing Figures

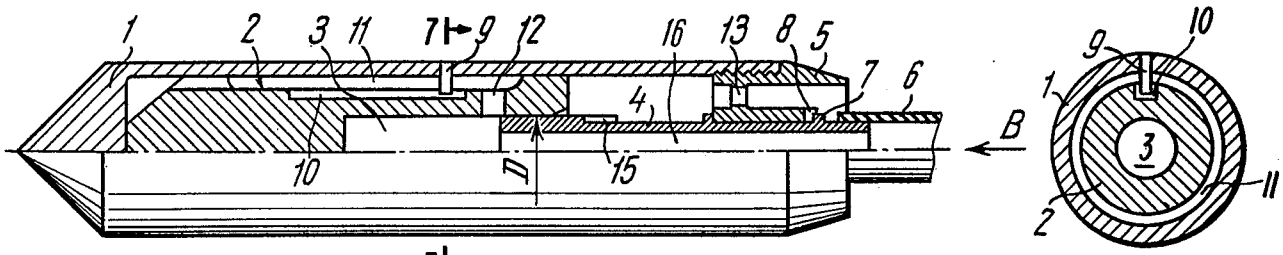
FIG. 1
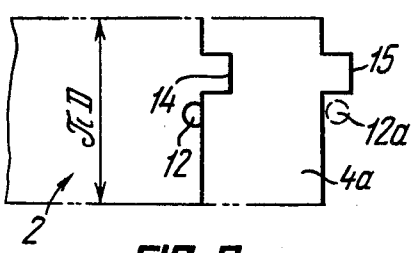
FIG. 2
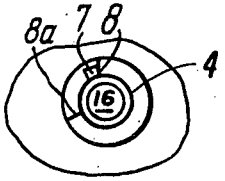
FIG. 3
FIG. 7

REVERSING PNEUMATIC PERCUSSIVE DEVICE

FIELD OF THE INVENTION

The invention relates to the field of construction technology and may be used for making short holes in stable soil for trenchless laying of underground communication lines, as well as for metal piling and formation of packed piles.

DESCRIPTION OF THE PRIOR ART

Known in the art is a reversible pneumatic percussive device designed for the same purpose which comprises a hollow cylindrical housing pointed at the front end, in the direction of hole formation, and a hammer piston mounted therein for reciprocation and for imparting blows in the direction of forward and backward movement of the device. The hammer defines with the housing a front end work chamber and has, at its rear end portion, a cylindrical space which receives a stepped pipe which defines with the hammer piston a rear end work chamber of the device. The pipe comprises rigidly interconnected sleeves and is coaxially mounted in the housing for rotation about its axis and for axial displacement, both rotation and displacement being restricted by a locking member within the limits providing for the reverse of the device. The device also comprises a rope connected to the locking member and limiting rotation of the pipe. During operation of the device, the rope is disposed within the hole, together with a flexible hose for feeding compressed air to the device, and always extends outside the hole at ground level.

The device is reversed by changing the position of the pipe relative to the housing. For that purpose, the operating device has to be stopped by disconnecting the compressed air supply, the rope should be tensioned, and the stepped pipe should be rotated 180° about its axis, the torque being transmitted through the flexible hose. Then the stepped pipe is displaced, by applying a tension to the flexible hose, into the rearmost position until it stops and is locked in this position by rotating it 180° in the opposite direction by means of the flexible hose.

The device can only be switched to forward movement again after it emerges from the hole to ground level. In order to switch the device over to forward movement, the above-described operations are to be made, with the following difference, the stepped pipe is changed to the foremost position by directly displacing it because the force for displacing the pipe forward cannot be transmitted through the flexible hose. Thus, the force for displacing the stepped pipe into the foremost position is applied to the tail portion of the pipe extending outside the housing and connected to the flexible hose.

This device is deficient in that it cannot be switched over from reverse movement to forward movement when the device is in the hole, the operation of the device is difficult due to the provision of the rope in addition to the flexible hose, the rope and hose intermingling in the hole during operation of the device, and reverse operation is complicated due to the use of the rope and two locking systems (one locking the stepped pipe against rotation about its axis and the other preventing axial displacement).

Known in the art are reversible pneumatic percussive devices used for similar purposes which feature a stepped pipe consisting of a sleeve fixed to the housing and a movable sleeve which is mounted coaxially with the fixed sleeve and is displaceable relative to the fixed sleeve under pressure of compressed air, a precompressed spring is located between the sleeves to urge them in the axial direction.

The device is reversed by changing the pressure of the air fed to the device, thus changing the force applied to the movable sleeve to displace it to the forward or rearward position relative to the fixed sleeve, thus resulting in the change of direction of blows.

This device is deficient in that the movement may be reversed by an accidental change in the pressure of the compressed air fed to the device.

SUMMARY OF THE INVENTION

It is an object of the invention to provide a reversible pneumatic percussive device which may be switched from reverse movement to forward movement when the device is in the hole.

Another object of the invention is to provide device of the above type which is simple in structure and convenient in operation and maintenance.

Still another object of the invention is to provide a device of the above type which can not be reversed by an accidental change in the pressure of the compressed air fed thereto.

These and other objects are accomplished by a reversible pneumatic percussive device comprising a hollow cylindrical housing which is pointed at the front end, in the direction of hole formation, and a hammer piston disposed coaxially in the housing. The hammer piston is prevented from rotating about its axis is mounted to reciprocate for imparting blows to the front end and rear end portions of the housing. The hammer piston defines with the housing a front end work chamber and has as its rear end a cylindrical space and at least one open-ended radial passage for establishing communication between the front end work chamber and the atmosphere and the cylindrical space at regular intervals. The cylindrical space receives a large portion of a stepped pipe which defines with the hammer piston a rear end work chamber; the small portion of the pipe is received in the rear end portion of the housing for rotation about its axis within the limits defined by a locking member. The pipe provides for permanent supply of the rear end work chamber with compressed air for opening the radial passage of the hammer piston at regular intervals to establish communication of between the front end of the work chamber and the rear end of the work chamber and for reversing the movement of the device. According to the invention, the large portion of the pipe is provided, at a front end face, with at least one recess and, at a rear end face, with a projection located is alignment with the recess. The lengths of the recess and projection are such that, when they are located in alignment with the radial passage of the hammer piston, air escapes from the front end work chamber at the position of the hammer piston which provides for imparting blows to the rear end portion of the housing, and air is admitted to the front end work chamber at the position of the hammer piston which provides for deceleration of the hammer piston, thus preventing blows from being imparted to the front end portion of the housing.

According to the invention, there is provided a reversible pneumatic percussive device which may be switched from reverse movement back to the forward movement when the device is in the hole. The device is simple in structure and convenient in operation and can not be reversed by an accidental change in pressure of compressed air fed thereto.

BRIEF DESCRIPTION OF THE DRAWINGS

The invention will now be described with reference to a specific embodiment thereof illustrated in the accompanying drawings, in which:

FIG. 1 shows a longitudinal, sectional view of a reversible pneumatic percussive device, according to the invention, with the hammer piston shown in the foremost position and the pipe in the position corresponding to forward movement of the device;

FIG. 2 is a schematic view of the cylindrical surfaces of the hammer piston and the pipe of a diameter "D" shown in FIG. 1 showing the relative position of the recess and the projection of the large portion of the pipe and the radial passage of the hammer piston corresponding to the position shown in FIG. 1;

FIG. 3 is an end view taken in the direction of the arrow "B" in FIG. 1 showing the position of the locking stops on a nut and the projection of the pipe for forward movement of the device (the hose being omitted for clarity);

FIG. 7 is a cross sectional view taken along the line 7–7 in FIG. 1.

DETAILED DESCRIPTION

Figure 4:
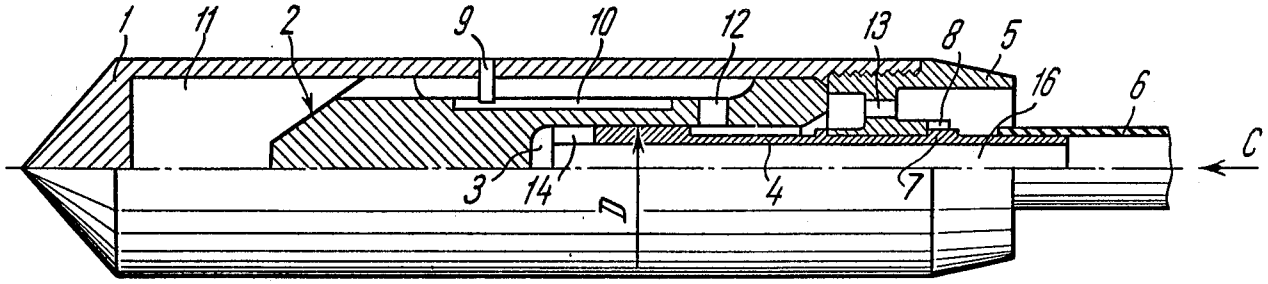
FIG. 4 is a longitudinal, sectional view of the reversible pneumatic percussive device, according to the invention, with the hammer piston in the rearmost position corresponding to reverse movement of the device.
Figure 6:
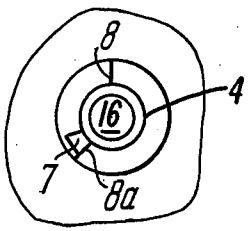
FIG. 6 is a view taken in the direction of the arrow C in FIG. 4 showing the position of the locking stops on a nut and the projection of the pipe for reverse movement of the device (the hose being omitted for clarity)

The device shown in FIGS. 1–7 comprises a hollow cylindrical housing 1 pointed at the front end, in the direction of hole formation, and accommodating a hammer piston 2 mounted for reciprocation and for imparting blows in the direction of either forward or backward. The hammer piston has at a rear end face a cylindrical space 3 in which the front end portion of a pipe 4 is received, in order to define with the hammer piston a rear end work chamber of the device. The pipe 4 has a rear end portion mounted coaxially with the housing and is rotatable about its axis in a nut 5 which is rigidly secured to the housing 1. A flexible hose 6 is connected to the rear end portion of the pipe 4 to feed compressed air to the device. Rotation of the pipe 4 about its axis is limited by a projection 7 on the outer surface of the pipe 4 and stops 8 and **8*a* on the inner surface of the nut 5. The hammer piston 2 is prevented from rotating about its longitudinal axis by means of a pin 9 fixed to the housing 1 and received in a longitudinal groove 10 an the outer surface of the hammer piston 2** (FIG. 7).

The inner surface of the housing 1 and the outer surface of the hammer piston 2 define a front end work chamber 11 of the device which communicates with the rear end work chamber 3 at regular intervals via a radial passage 12 in the hammer piston 2. The nut 5 has longitudinal passages 13 to permit the escape of air into the atmosphere at regular intervals from the front end work chamber 11 of the device.

The large portion **4*a* of the pipe 4 is provided, at a front end face, with a recess 14 and, at a rear end face, with a projection 15 located in alignment with the recess 14**.

The relative arrangement of the parts of the device during forward movement is shown in FIGS. 1–3. The projection 7 (FIG. 3) of the pipe 4 engages the stop 8 of the nut. The radial passage 12 is displaced along the circumference relative to the recess 14 and projection 15.

The device functions in the following manner during forward movement. Compressed air is fed from a source (not shown), via a the flexible hose 6 (FIG. 1) and the axial passage 16 of the pipe 4, to the rear end work chamber 3, from which it is admitted, via the radial passage 12 of the hammer piston 2, to the front end work chamber 11. The hammer piston 2 starts moving from the foremost position shown in FIG. 1 backwards (to the right in FIG. 1) because, due to there being the same pressure in the work chambers 11 and 3, the force applied to the hammer piston 2 on the side of the chamber 11 is greater than that on the side of the chamber 3, since for the working area of the hammer piston is greater. After the passage 12 of the hammer piston is closed by the pipe 4, and the admission of compressed air to the front end work chamber 11 is interrupted, the hammer piston 2 continues its movement backward by the action of the air expanding in the front end work chamber 11. As the hammer piston 2 continues to move backwards, the passage 12 thereof is displaced past the rear end face edge of the large portion **4*a* of the pipe 4 and is in the position 12*a* shown in dotted lines in FIG. 2. Air is passed from the front end work chamber 11, via the radial passage 12*a* of the hammer piston 2 and the passage 13 of the nut 5, into the atmosphere. The hammer piston 2 is stopped by the action of a force created by the air pressure in the rear end work chamber 3 in permanent communication with a source of compressed air and then moves forward (to the left in FIG. 1) to impart a blow to the housing 1** (this position of the hammer piston is shown in FIG. 1). Then, the cycle is repeated.

By the action of the blows, the housing 1 penetrates the soil to compact it and to form a hole having smooth consolidated walls. This mode of operation occurs during forward movement of the device.

Backward movement of the housing by the action of reaction forces developed during reciprocation of the hammer piston is prevented by friction forces between the outer surface of the housing 1 and the soil.

In the formation of vertical (blind) holes, when the device hits an obstacle (large boulders), when an incorrect turn in the hole path has been made or when the device is to be disengaged from the pipe being driven thereby, the device is to be reversed.

Figure 5:
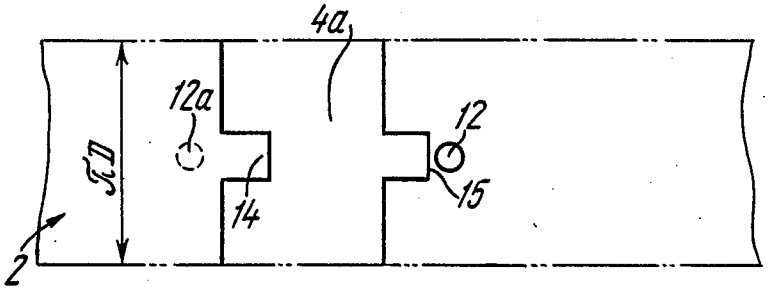
FIG. 5 is a schematic view of, cylindrical surfaces of the hammer piston and the pipe of a diameter "D" shown in FIG. 4 showing the relative position of the recess and the projection of the large portion of the pipe and the radial passage of the hammer piston corresponding to the position shown in FIG. 4.

For reverse motion, the device should be stopped by closing the compressed air supply. The flexible hose is then disconnected from the compressed air source and the hose is rotated in such a manner as to rotate the pipe 4 rigidly connected thereto, so that its projection 7 (FIG. 6) engage the stop **8*a* of the nut 5. Thus, the large portion 4*a* of the pipe 4 is caused to rotate about its axis and relative to the radial passage 12 of the hammer 2 as shown in FIG. 5. Thus, the stepped pipe 4 is positioned relative to the hammer piston 2 in such a manner that the projection 15 of the rear end face and the recess 14** of the front end face of the large portion 4*a* of the pipe 4 are located opposite the passage 12. This results in admission of compressed air to the front end work chamber 11, and the hammer piston is decelerated by air pressure in this chamber without imparting blows to the housing. During the movement of the hammer piston 2 towards the nut 5, air escapes from the chamber 11 with a delay because the passage 12 of the hammer piston 2 is now opened by the end face edge of the projection 15, rather than by the rear end face edge of the large portion 4*a*, as was the case during forward movement of the device. Therefore, the stroke of the hammer piston in the direction of the nut 5 increases so that the hammer piston will impart a blow with its rear end face to the nut 5 (FIG. 4).

The device is thus reversed to move out of the hole by the action of such blows.

What is claimed is:

1. A reversible pneumatic percussive device comprising: a hollow cylindrical housing pointed at a front end, in the direction of hole formation; a hammer piston accommodated in said housing so as to prevent rotation about its axis and mounted for reciprocation to impart blows to the front end portion and a rear end portion of said housing, the hammer piston defining with said housing a front end work chamber and having, at a rear end part, a cylindrical space and at least one open-ended radial passage for establishing communication between said front end work chamber and the atmosphere and said cylindrical space at regular intervals; a stepped pipe having a large portion received in said cylindrical space of said hammer piston to define a rear end work chamber, a small portion of said pipe being received in the rear end portion of said housing for rotation about its axis within limits define by locking members, the pipe providing for permanent supply to said rear end work chamber of compressed air, said pipe opening the radial passage of said hammer piston at regular intervals to establish communication between said front end work chamber and said rear end work chamber, said pipe having at least one recess at a front end face of the large portion and a projection at a rear end face of the large portion which is located in alignment with said recess, the lengths of said recess and said projection being such that, when they are located opposite the radial passage of said hammer piston, air escapes from said front end work chamber at the position of said hammer piston which provides for imparting a blow to the rear end portion of said housing and compressed air is admitted to said front end work chamber at the position of said hammer piston to prevent a blow from being imparted to the front end portion of said housing, thereby reversing the movement of the device.

* * * * *